United States Patent [19]

Marshall

[11] 4,341,272

[45] Jul. 27, 1982

[54] METHOD FOR FREEING STUCK DRILL PIPE

[76] Inventor: Joseph S. Marshall, 611 Eastland Ave., Ruston, La. 71270

[21] Appl. No.: 138,582

[22] Filed: May 20, 1980

[51] Int. Cl.[3] ..... E21B 31/00

[52] U.S. Cl. ..... 175/65; 175/317; 166/301

[58] Field of Search ..... 175/317, 237, 243, 65; 166/301, 318, 178

[56] References Cited

U.S. PATENT DOCUMENTS

| | | | |
|---|---|---|---|
| 3,053,322 | 9/1962 | Kline | 166/318 |
| 3,195,660 | 7/1965 | McKown | 175/317 |
| 3,213,941 | 10/1965 | Nelson | 166/301 |
| 3,554,281 | 1/1971 | Ecner | 166/318 |
| 4,241,797 | 12/1980 | Allen | 175/317 |
| 4,252,196 | 2/1981 | Silberman et al. | 166/318 |

*Primary Examiner*—William F. Pate, III

*Attorney, Agent, or Firm*—Gary Honeycutt

[57] ABSTRACT

This invention relates to a valve assembly (drawing) which will hereafter be referred to as drill pipe freer, comprising a metal ball, hollow in the center, and of such design that it will float in liquid, or a floating solid plastic ball of such design and hardness to withstand the pressures to be encountered during operation of the invention, and a specially designed valve body with seat for the metal or plastic ball. The said valve body will be pumped down inside the string of drill pipe and collars within the well bore to anchor at drilling bit at lower end of drill pipe string. The said metal or plastic ball is then pumped down to seat itself within the said valve body seat, closing off the mud circulation (drilling fluid) which normally flows through drill pipe and out drilling bit and back up annulus of well bore. This sudden cessation of downward flow of drilling fluid will provide a water hammer blow to dislodge drill pipe lodged in off-bottom positions within well bore.

3 Claims, 2 Drawing Figures

METHOD FOR FREEING STUCK DRILL PIPE

In the operations of oil and gas drilling rigs that this invention is concerned with, a bore hole is drilled in the earth's surface with the use of a cylinder member (string of drill pipe and drill collars) and a cutter or rock bit secured to the end of said drill pipe to rotate conjointly with drill pipe and drill collars. In these drilling operations the cylinder member will be made up of perhaps ten (10) (more or less) drill collars with slightly less outside diameter than the said rock bit and approximately thirty (30) feet per stand in length; following, attached to the drill collars, are drill pipe which have a smaller outside diameter then the drill collars and are approximately thirty (30) feet in length.

This afore-described drill string, being of varying diameter, is prone to an oil and gas drilling operations problem known as stuck drill pipe. This usually occurs when the drill string is being withdrawn from the well bore to replace worn drilling bits, and results in a suspension of drilling rig operations until the drill string can be dislodged.

The withdrawing of drill string from well bore is a frequent and normal procedure. During the withdrawal procedure drill strings sometimes become stuck because of a differential in well bore diameter known in oil and gas drilling operations as a key seat condition. A key seat occurs as the drill pipe, smaller than drill collars and drill bit, has a tendency to "wallow" back into the side of well bore (no well bore can be kept perfectly perpendicular during drilling operations). When drill string is being withdrawn to replace drill bit, drill collars and/or drill bit may become lodged in constricted "key seated" condition caused by wallowing drill pipe.

The above mentioned factor causing stuck drill strings is only one example of the factors that contribute to stuck pipe problems. The following new invention can overcome many of such sticking conditions and greatly reduce the financial expense and time-consuming delay caused by drill strings lodged in differential well bores. This new invention provides an improved means of dislodging stuck drill strings from the afore-described differential well bore conditions.

Following is a description complete with drawings of this new invention relative to its function and method of operation:

Figure 1:
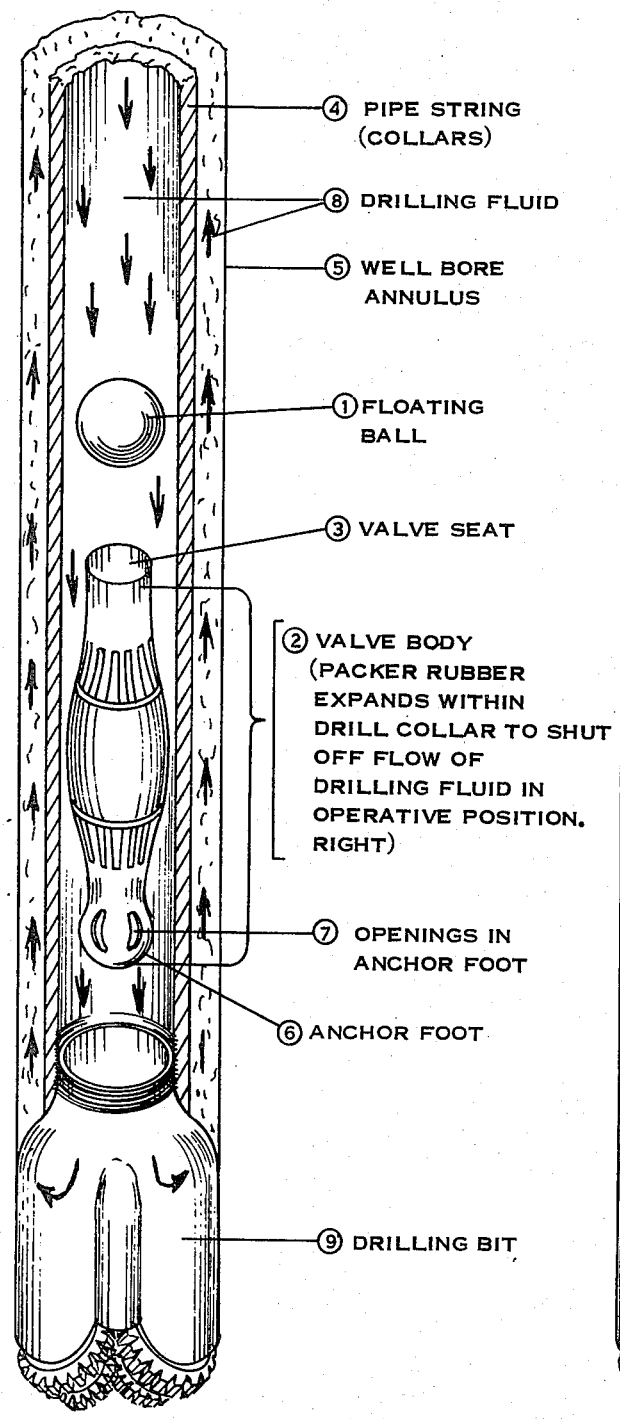
FIG. 1 is a vertical cutaway sectional view of a drill collar within the well bore of a drilling rig showing the valve assembly known here-in as drill pipe freer in pre-operative position relative to well bore annulus (10) and drilling bit (11). Pipe freeing device (drill pipe freer) consists of two parts, a floating metal or plastic ball (2) and valve body (3).

In FIG. 1 hollow metal ball (2) of sufficient hardness and buoyancy to float in drilling fluid (8) within the drill collar (9) and withstand pressures to be encountered, or a floating solid plastic ball with the above described characteristics, is shown in pre-operative position above valve body (3) which is designed to anchor at drill bit (11) and, in tandem with the aforesaid ball (2) seal off the circulation of said drilling fluid (8).

Valve body (3) is of hollow tubular construction designed at upper end to receive ball (2) and at lower end to seat at drilling bit (11). When said valve body seats, drilling fluid (8) flows through said valve body (3) via openings in anchor foot (7). When valve body is in position, anchored at drilling bit (11), entire flow of drilling fluid (8) is diverted to outside of said valve body (3) when ball (2) seats in valve seat (6) at upper end. This outside flow activates packer rubber (4) (commercially obtainable) which expands against sides of drill collar (9) instanteously completing seal and halting flow of said drilling fluid (8).

Figure 2:
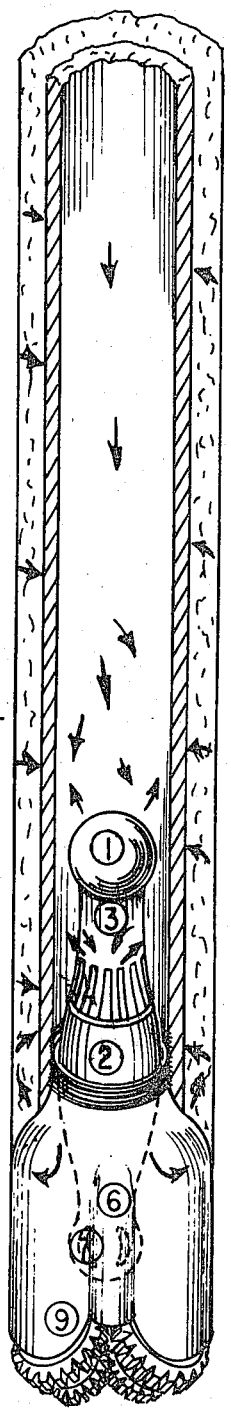
FIG. 2 is a vertical cutaway sectional view of drill collar showing pipe freer in operative position after valve body (2) anchors at drilling bit (11) and floating plastic or metal ball (2) seats into valve body (6) closing off mud circulation here-in described as drilling fluid.

In FIG. 2 ball (2) is in operative position seated in valve body (3). Said ball (2) and said valve body (3) with packer rubber, act in tandem to seal off flow of said drilling fluid as described above. The abrupt cessation of downward flow of drilling fluid acts to force drill string (9) down and out of stuck position (key seat) by imparting a water hammer-like impetus. At moment of impact when ball (2) seats in valve body (3) and drilling fluid (8) is halted, there is a counterthrust of drilling fluid (8) back up hole within drill string (9). A commercial valve on mud pump at surface (standard equipment on oil and gas drilling rigs) relieves pressure from this back-flow and allows said drilling fluid (8) to flow out at surface into mud pits (also standard drilling rig equipment). Said buoyant ball (2) is flung back up pipe string (9) by the counterthrust of drilling fluid (8) and, after crewmen have closed mud pump valve at surface and restarted pumps, is in position for another trip down to said valve body (3) to seat at valve body and impart another water hammer blow. Operation can be repeated as often as necessary.

As drill string (9) is freed, there is a need to prevent its fall into the open well bore below lodged position. For this, elevators (not shown, standard rig equipment) have been latched 6 to 8 inches below collar (embossed coupling box) of topmost joint of drill pipe. This positioning of elevators limiting fall of drill string also eliminates any danger of pipe "corkscrewing" within well bore. When said drill string (9) falls free of stuck position, elevators will catch on collar and hold said drill string (9) in free position.

Generally, after freeing drill string, it is necessary to enlarge the well bore stricture (key seat area) by circulating drilling fluid (8) back down drill string (9), out drill bit (11) and back up annulus of well bore (10) to erode stricture. To regain circulation of said drilling fluid (8), ball (2) must be retrieved from inside drill string (9). To do so, an overshot (commercially obtainable) will be lowered on the end of a wire line (not shown) within the drill string (9). Upon contact of overshot with ball (2) the overshot latching device will lock and enable drilling rig crewmen to withdraw said ball (2) allowing free circulation of drilling fluid (8). Valve body (3) will remain anchored at drill bit (11) and will in no way impede circulation of drilling fluid or hinder further operations, and may be removed simply and quickly during the replacement of the drilling bit (11).

I claim:

1. A method for dislodging a stuck-off-bottom drill string, including a drill bit and drill pipe, comprising the steps of:

(a) pumping a valve body down inside the drill string to anchor at or above the drill bit in a position to receive a spherical member for sealing action, said valve body having means for diverting drilling fluid into means for expanding its diameter upon receiving said spherical member, thereby sealing itself against the inside of the drill string and consequently blocking off flow in the drill string; and (b) pumping said spherical member down the drill string to seat in said valve body, thereby causing said body to expand and block the flow of drilling fluid, resulting in a hammer-like impetus to force the drill string down and out of the stuck position.

2. A method as in claim 1 wherein said spherical member is buoyed by the drilling fluid upon cessation of flow, further including the step of again pumping the spherical member down to seat in the valve body to repeat the said impetus.

3. A method as in claim 1 wherein said means for expanding the diameter of the valve body includes means for diverting the drilling fluid, and an expandible packer for receiving the diverted fluid, whereby the packer causes the sealing action against the inside of the drill string.

* * * * *